United States Patent [19]

Simeth

[11] 4,060,238

[45] Nov. 29, 1977

[54] DEVICE FOR THE SMOOTH AND FLUTTER-FREE FEEDING OF SHEETS ON SHEET-FED MACHINES, PARTICULARLY OFFSET PRINTING PRESSES

[75] Inventor: Claus Simeth, Offenbach, Germany

[73] Assignee: Roland Offsetmaschinenfabrik Faber & Schleicher AG, Germany

[21] Appl. No.: 740,204

[22] Filed: Nov. 9, 1976

[30] Foreign Application Priority Data

Nov. 12, 1975 Germany ..... 2550721

[51] Int. Cl.[2] ..... B65H 5/22

[52] U.S. Cl. ..... 271/276; 101/420; 101/422; 271/80; 271/195

[58] Field of Search ..... 271/80, 82, 195, 276, 271/277, 275; 226/191; 101/416 R, 416 A, 420, 422, 409

[56] References Cited

U.S. PATENT DOCUMENTS

| | | | |
|---|---|---|---|
| 3,341,195 | 9/1967 | Brandt et al. | 271/276 |
| 3,602,140 | 8/1971 | Sudduth | 271/277 X |
| 3,642,274 | 2/1972 | Herrington et al. | 271/80 X |
| 3,780,925 | 12/1973 | Ternes | 226/191 |
| 3,791,644 | 2/1974 | DeMoore | 271/275 X |
| 3,986,455 | 10/1976 | Jeschke et al. | 271/276 X |

*Primary Examiner*—Bruce H. Stoner, Jr.

*Attorney, Agent, or Firm*—Leydig, Voit, Osann, Mayer & Holt, Ltd.

[57] ABSTRACT

A feed drum assembly for feeding sheets in succession to the impression cylinder of a lithographic printing press which includes a cylindrical mantle having an axially and circumferentially distributed array of spacers which are spaced radially outward from the surface of the mantle at a constant spacing to define a support for the sheet as it makes a partial turn about the drum. An axially extensive nozzle directs air at high velocity in a direction chordwise of the drum and into the region between the sheet and the mantle. The change in direction of the air as it strikes and tends to follow the curved surface of the mantle creates an inward suction upon the sheet to draw the sheet against the spacers and thereby prevent fluttering as the sheet is transported at high speed. In the preferred embodiment of the invention the spacers are in the form of small, individually rotatable rollers smoothly surfaces with ink repellent synthetic material.

5 Claims, 3 Drawing Figures

DEVICE FOR THE SMOOTH AND FLUTTER-FREE FEEDING OF SHEETS ON SHEET-FED MACHINES, PARTICULARLY OFFSET PRINTING PRESSES

It has been known for many years that a thin sheet of paper, fed by a feed drum to the grippers on an impression cylinder, tends to flutter, with the problem becoming particularly acute as presses operate at higher and higher speeds. Various devices, having different degrees of complexity, have been devised to control flutter, but such devices, or constructions, as far as is known, have not been completely effective. One of the problems is that the sheet must be supported on the drum upon its freshly inked side so that anti-flutter has frequently been purchased at the expense of smearing of the linked impression, thereby reducing the quality of the printing.

Typical prior art constructions include the following: In German Gebrauchsmuster 1,891,447 a transfer drum is provided carrying rods mounting small rollers capable of being shifted longitudinally and formed of ink-repellent material. British patent 972,487 (1964) similarly discloses a transfer drum having sheet-engaging rollers which are separately shiftable in an attempt to avoid the inked areas of the sheets. British Patent 1,057,603 (1967) discloses a drum having insertable sheet-supporting buttons which are positioned to primarily engage the non-inked areas. To similar effect is German Auslegeschrift 1,213,429. U.S. Pat. No. 3,602,140 discloses the use of discs or rollers spaced about the circular edge of the feed drum for contacting the non-inked edge portions of the sheet. Finally, U.S. Pat. No. 3,334,897 shows means for directing air radially outwardly against a sheet being transported on a feed drum.

It is an object of the present invention to provide a feed drum assembly which prevents fluttering of the sheet during high speed transport to the grippers on an impression cylinder and which supports the sheet on its inked side but which is, nonetheless, free of any smearing tendency.

It is a more specific object to provide a feed drum assembly including a cylindrical mantle, with an axially and circumferentially distributed array of spacers at a constant spacing outwardly of the surface of the mantle and which includes means for causing the sheet to be seated stably and without flutter against the spacers with a predetermined, uniform seating force, free of any relative movement between the sheet and the spacers, so that smearing of the ink on the sheet is entirely obviated. The desired suction is achieved by directing parallel jets of high velocity air into the region between the sheet and the mantle and in a direction which is chordwise of the drum, with the change in the direction of the air as it strikes, and tends to follow, the curved surface of the mantle serving to create suction upon the sheet by Bernoulli's principle, tending to draw the sheet into light, stable contact with an array of supporting spacers, with the suction field remaining constant as the drum assembly rotates.

Figure 1:
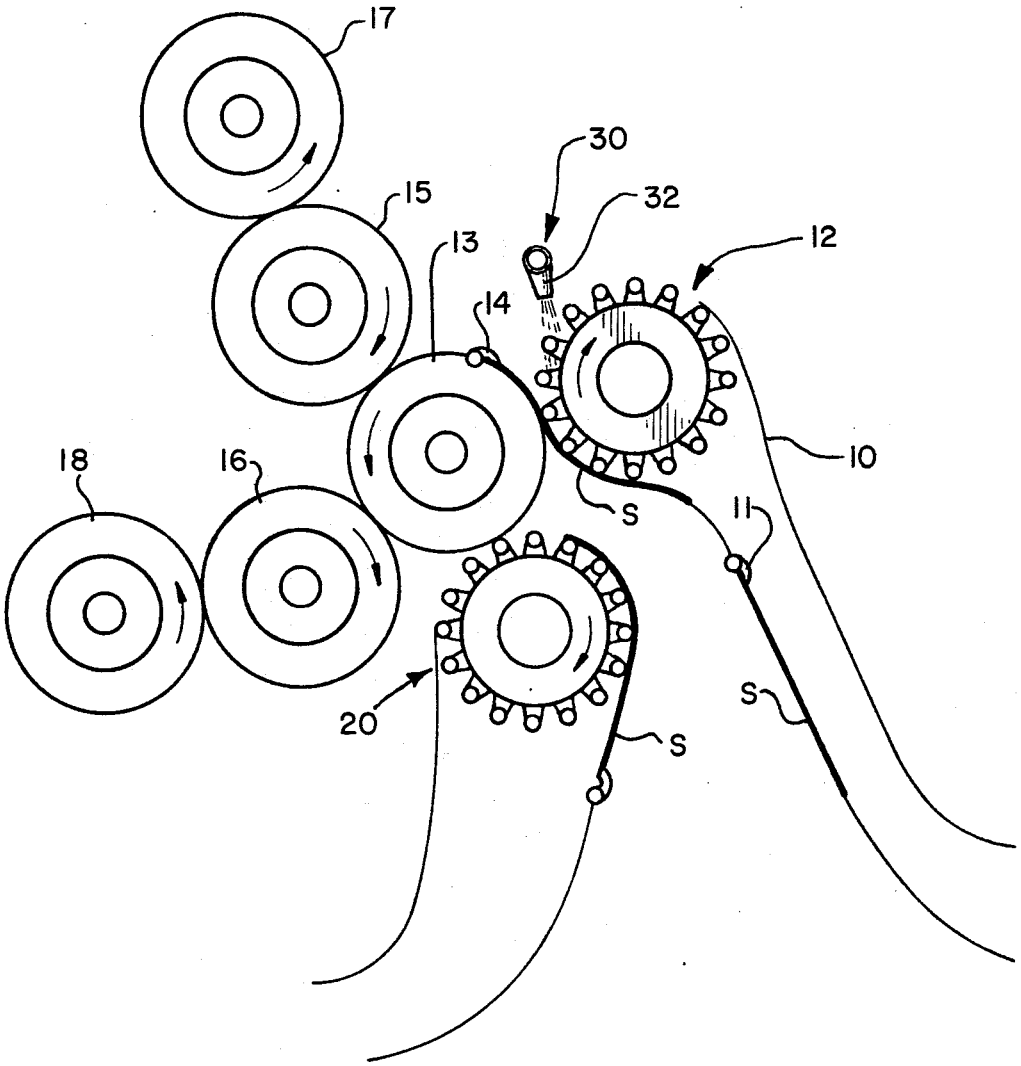
FIG. 1 is an elevational view, somewhat diagrammatic, showing the invention installed in a printing press.

Turning now to the drawings there is disclosed in FIG. 1, in simplified diagramatic form, the principle elements of a lithographic printing press. A sheet S is transported into printing position on an endless conveyor 10, the leading edge of the sheet being gripped by a set of grippers 11. The conveyor terminates at a feed drum assembly 12 at which point the conveyed sheets are transfered to an impression cylinder 13 where the leading edge is gripped by grippers 14. The means for achieving timed operation of the grippers 11–14 in effecting transfer of the sheet is well understood by one skilled in the art and need not be described in detail. It will suffice to say that the sheet, as it is rotated around on the impression cylinder, receives inked impressions, in succession, from blanket cylinders 15,16 which have cooperating plate cylinders 17,18 respectively. The means for inking the printing plates on the cylinders 17,18 are conventional and well understood by those skilled in the art. After printing is completed the sheets are removed from the impression cylinder by suitable endless conveyor assembly indicated generally at 20.

Figure 2:
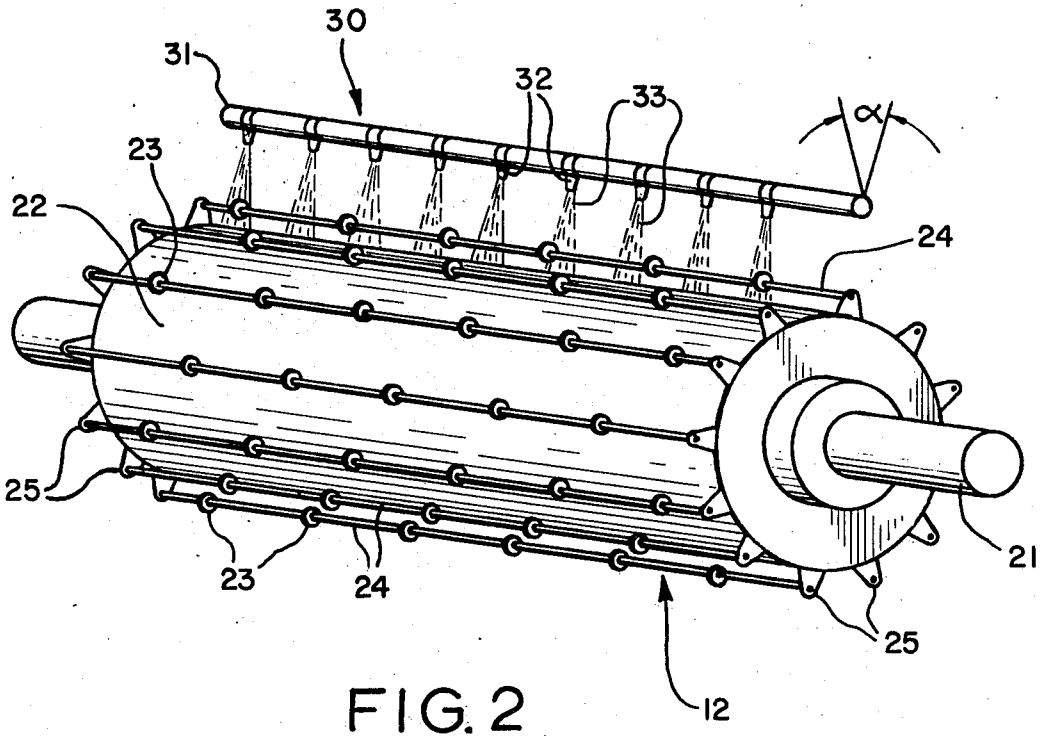
FIG. 2 is a perspective view of the feed drum assembly of FIG. 1.

Focusing more specifically on the construction of the feed drum assembly 12, reference is made to FIG. 2 where it is seen that the assembly includes a rotatable core 21. Mounted upon the core is a cylindrical mantle 22 having a substantially smooth, curved surface which is concentric with the axis of rotation. Surrounding the mantle is an array of spacers 23. Such spacers are axially and circumferentially distributed with respect to one another at a constant radial distance from the surface of the mantle 22. The spacers are supported upon axially extending rods 24 which extend between paired radially extending spokes or brackets 25. Preferably each of the spacers is in the form of a roller freely rotatable upon its supporting rod while inhibited against axial movement along the rod, with each roller being smoothly surfaced and preferably coated with synthetic ink repellent material such as Teflon. The rollers, taken together, form a cylindrical locus for supporting the presented surface of a sheet. As will be noted in FIG. 1 a sheet, in its travel about the supporting surface of the feed drum makes only a partial revolution; indeed, the travel is limited to less than about 90°, so that the region between the sheet and the mantle is open and accessible.

In accordance with the present invention an axially extensive nozzle is provided for directing high velocity air into the region between the sheet and the surface of the mantle, with the direction of the air being chordwise of the drum and with the result that the air tends to create light suction upon the transported sheet holding it in stable contact with the presented surfaces of the spacers and inhibiting fluttering of the sheet as it is transfered from the conveyor to the impression cylinder. Preferably I provide a nozzle assembly 30 which extends parallel to the drum axis. The nozzle assembly includes a longitudinally extending manifold 31 having a plurality of nozzles 32 which create parallel jets of air 33, all of the nozzles being oriented so that the jets 33 are directed into the annular space between the sheet and the surface of the mantle and with at least some of the air in the jets being oriented in a chordwise direction. By "chordwise" is meant that the air strikes the feed drum assembly along a chordal direction to cause a change in the direction of the air as it strikes the surface of the mantle, with the air tending to follow the curved surface of the mantle while at the same time creating a region of light suction, in accordance with the principle of Bernoulli, drawing the sheet into contact with the array of spacers so that the sheet is stably supported while it is being transported, around the drum, at high peripheral speed.

It is found that the nature of the support is such that no smearing of the presented surface of the sheet occurs even though the sheet has been freshly printed, in one or more colors, by a press unit in advance of being transported upon the conveyor assembly 10.

The smearing tendency is doubly reduced by the fact that the individual spacers 23 are in the form of small, smoothly surfaced rollers which are formed of, or coated with, ink repellent synthetic plastic as, for example, Teflon. The anti-flutter, anti-smear tendency cannot be entirely explained by the use of the roller construction and material, however, since rollers formed of teflon have been used on drum assemblies previously without achieving the advantages of the present invention. From this it must be concluded that the benefits of the invention are derived from a combination of the spacers and the axially extensive nozzle means with its chordwise-directed jets of air.

Figure 3:
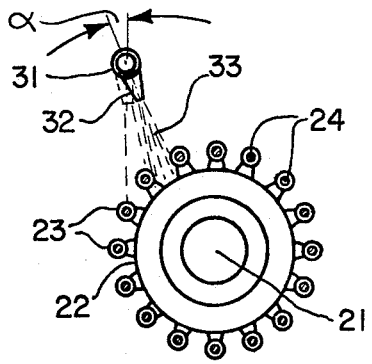
FIG. 3 is an end view of the feed drum showing the range of nozzle adjustment.

Preferably means are provided for mounting the axially extending manifold 31 so that it is twistable about its own axis over a range of angle $\alpha$ (see FIG. 3), the angle, and the air velocity, both being optimized, in a particular case, by trial and adjustment procedure, a matter which is well within the skill of the art. The jets of air 33 are preferably injected into the region between the sheet and the curved surface of the mantle in a direction which is contrary to the direction in which the mantle is rotated.

What I claim is:

1. A feed drum assembly for feeding sheets in succession to an impression cylinder of a lithographic printing press comprising, in combination, a rotatable core, a cylindrical mantle mounted on the core and having a substantially smooth surface which is concentric with the core, an axially and circumferentially distributed array of spacers spaced radially outward from the surface of the mantle at a constant spacing to define a sheet supporting locus, means for guiding a sheet onto and away from the sheet supporting locus so that the sheet makes only a partial turn about the drum, and axially extensive nozzle means stationarily mounted with respect to the drum and spaced outwardly therefrom for directing high velocity air chordwise of the drum and into the region between the sheet and the mantle, the change in direction of the air as it strikes and tends to follow the curved surface of the mantle serving to create suction upon the sheet drawing the sheet into contact with the array of spacers and thereby preventing fluttering of the sheet as it is passed to the impression cylinder.

2. The combination as claimed in claim 1 in which the spacers engage the inked side of the sheet and in which the spacers are smoothly surfaced with ink repellent synthetic material.

3. The combination as claimed in claim 2 in which the spacers are in the form of small rollers rotatably mounted for rotation about axes parallel to the drum axis.

4. The combination as claimed in claim 1 in which the air is in the form of a jet moving contrary to the direction of movement of the engaged surface of the mantle.

5. The combination as claimed in claim 1 in which the nozzle means is rockable about an axis parallel to the drum axis to vary the angle between the high velocity air therefrom and the drum, thereby to vary the degree of suction applied to the sheet.

* * * * *